US006136232A

United States Patent [19]

Burlingame

[11] Patent Number: 6,136,232

[45] Date of Patent: Oct. 24, 2000

[54] ELECTRO-STATIC DISSIPATIVE ZIRCONIA

[75] Inventor: Nicholas H. Burlingame, Belmont, N.Y.

[73] Assignee: Xylon Ceramic Materials Inc., Alfred Station, N.Y.

[21] Appl. No.: 09/374,149

[22] Filed: Aug. 13, 1999

[51] Int. Cl.[7] ..... H01B 1/08

[52] U.S. Cl. ..... 252/521.1; 252/520.5; 252/518.1

[58] Field of Search ..... 252/520.2, 520.5, 252/521.1, 518.1; 338/20, 21, 22 R

[56] References Cited

U.S. PATENT DOCUMENTS

| | | | |
|---|---|---|---|
| 2,528,121 | 10/1950 | Dickinson | 173/344 |
| 4,110,260 | 8/1978 | Yamamoto et al. | 252/519 |
| 4,316,964 | 2/1982 | Lange | 501/105 |
| 4,931,214 | 6/1990 | Worrell et al. | 252/520 |
| 5,830,819 | 11/1998 | Shikata et al. | 501/153 |

*Primary Examiner*—Mark Kopec
*Attorney, Agent, or Firm*—Christopher A. Gallo

[57] ABSTRACT

Electro-static dissipative or ESD materials must possess sufficient conductivity to allow for the dissipation of static charges while maintaining enough insulating characteristics to prevent shorts. Described here in are ceramic ESD materials comprised of stabilized zirconia and lanthanum chromate.

19 Claims, No Drawings

ELECTRO-STATIC DISSIPATIVE ZIRCONIA

BACKGROUND OF THE INVENTION

The present invention generally relates to the field of low resistivity ceramics. In particular, it relates to a new zirconia-based material in which the electrical conductivity can be controlled in a range to provide for its use as an electrostatic dissipative or "ESD" material.

Currently the ESD market is served by organic i.e. plastic materials. Organic based materials such as electro-conductive resin composite materials lend themselves to inexpensive molding processes and can be tailored to meet specific resistance requirements. U.S. Pat. No. 5,409,968 Controlled Conductivity Antistatic Articles illustrates such materials for use as an ESD material. This group of materials suffers significant shortfalls in their mechanical properties, heat resistance, and chemical resistance thereby limiting their usefulness.

There are numerous ceramic materials variously referred to as electro-conductive ceramics. Some are conductive in the bulk state, others upon doping or admixture with other materials. Each has limitations making it unsuitable for ESD applications e.g., a narrow range of specific resistance that cannot be adjusted for ESD applications. Others are much too conductive for use as an ESD materials. Many suffer from poor mechanical properties and do not make useful structural materials.

Electro-conductive composite ceramics typically consist of a mix of a electroconductive material with a ceramic material with a relatively high electrical resisitivity. These phases are variously interdispersed to yield some combination of the properties of each. The electro-conductive material can be a metal or a conductive ceramic. U.S. Pat. Nos. 4,110,260, 2,528,121 and 5,830,819 describe such materials. Such materials can be difficult to prepare requiring expensive processing such as hot-pressing to produce. Additionally some of these suffer from poor mechanical properties.

Many materials which might be contemplated for producing electro-conductive composite ceramics are not compatible at the high temperatures required in typical ceramic processing. The various components will chemically interact with the result being that the beneficial properties of the separate materials are degraded upon reaction.

This invention provides an electro-conductive composite ceramic with both the electrical and mechanical properties to render it particularly useful for applications such as ESD materials.

OBJECTS OF THE INVENTION

It is the object of the invention to provide an electro-conductive composite ceramic with a toughened zirconia matrix.

It is also an object of the invention to provide a composite material with a conductive phase comprised of a perovskite-type electro-conductive metal oxide with the general formula $AxByCrO_3$.

It is another object of the invention to provide a material with both the electro-conductive and mechanical properties to render it useful for ESD applications.

It is yet another object of the invention to provide for a material with electro-conductive properties which may be tailored for a specific application.

It is another object of the invention to provide sintered products which will be useful in the semiconductor industry as handling jigs, tweezers, conveyer arms and the like.

SUMMARY OF INVENTION

The inventor has developed a novel composite material. This material is comprised of a toughened zirconia and a conductive perovskite-type phase. It possesses the strength and toughness typically associated with partially stabilized zirconia as well as providing a controllable electro-conductvity. Notably, the inventor has chosen the materials such as to allow static charge dissipation while still providing insulation against electrical shorts, thus rendering it ideal for ESD applications. For these applications composites have volume resistivities of from about 1×E4 ohm-cm to about 1×E11 ohm-cm.

The expression "perovskite-type" used herein means perovskite and pseudoperovskite oxides such as orthorhombic derivatives and distorted orthorhombic derivatives of perovskite crystal structure.

DETAILED DESCRIPTION

The invention will now be described in greater detail. Examples are included to illustrate the invention and applicants shall not be limited to the embodiments contained therein.

The invention is generally comprised of a two component composite material. The first component is a zirconia-based matrix. It is preferred to use a toughened zirconia. The toughened zirconia alloy being partially stabilized with from 2.6% to 10% of a stabilizing metal oxide. Known stabilizers are yttria, and stabilizing rare earth oxides (La, Ce, Sc, Nd, Yb, Er, Gd, Sm and Dy) and the alkaline earth oxides magnesia, and calcia. Most preferred as a stabilizer is yttria.

Toughened zirconia is known for its high toughness and strength. Yttria partially stabilized zirconia (Y-PSZ) being one of the strongest ceramics commercially available. The excellent mechanical properties result from a substantial portion of the zirconia being in the tetragonal structure. Additionally, composite materials which contain toughened zirconia can have excellent mechanical properties as shown in U.S. Pat. No. 4,316,964: Al2O3/ZrO2 Ceramic. These mechanical properties are advantageous as ESD materials as they are often required to perform structural functions as well.

The second component is the electro-conductive phase. This phase is comprised of a perovskite-type material with a composition represented by the formula of $AxByCrO_3$, where: A is a trivalent metal selected from La, Y, Sc, Nd, Yb, Er, Gd, Sm and Dy and mixtures thereof, B is a divalent metal selected from Ba, Sr, Ca, and Mg and mixtures thereof, X is 0.5 to 1.0, Y is 0 to 0.5, and X+Y=~1.

While primarily a chrome containing perovskite-type material, some of the chrome can be replaced with Cu, Zn, Nb, Al, Fe, Mn. Preferred amounts of Cu and Zn would replace up to 15 atomic percent of the Cr. Preferred amounts of Nb would replace up to 5 atomic percent of the Cr. Preferred amounts of Al, Fe, Mn would replace up to 5 atomic percent of the Cr.

Additionally materials such as CuO, $Cu_2O$ and ZnO can be added as sintering aids. Preferred ranges of these additions would be up 2 weight percent of the total.

The chrome containing perovskite-type system was selected as the electro-conducting phase as it is uniquely chemically stable in combination with partially stabilized zirconias in that the chrome containing perovskite-type material and the partially stabilized zirconias do not extensively interact at typical sintering temperatures. This mutual chemical stability allows maintaining the beneficial mechanical properties of the partially stabilized zirconia and the electroconductive properties of the chrome containing material.

Notably, other perovskite-type compounds such as $LaMnO_3$ and $LaFeO_3$ are not chemically stable in combinations with partially stabilized zirconias and at typical sintering temperatures form secondary zirconia compounds such as $La_2Zr_2O_7$ thus effecting the phase stability of the remaining zirconia alloy.

The electrical properties of the chrome containing perovskite-type material can be substantially modified by varying the ratio and chemical type of A and B, and hence can be adjusted to meet various application requirements.

Additionally chemically inert filler materials can be added and still retain the toughening effect of the zirconia, an example of such a material is alumina.

Fabrication may be accomplished through many known methods. Typical steps could include preparing a powder mix, forming a green member from the powder mix, and sintering the green member. The perovskite-type powder can be prepared by chemical preparation methods or by mixing and milling of oxides and carbonates. The zirconia based material can be prepared by chemical preparation methods or commercially available pre-alloyed partly stabilized oxides can be employed. The mix of perovskite-type material and the zirconia based material can be produced simultaneously by chemical preparation methods or by mixing of oxides.

It is preferred that the powder's particle size be generally below 1 micron. The green members can be formed by standard processes such as die pressing, isostatic pressing, slip casting, injection molding, tape casting, and extrusion.

The green members can be fired to form a sintered member with a generally zirconia structure with a perovskite-type second phase. For sintering temperatures above 1450° C. an inert or reducing environment is beneficial in controlling Loss of Cr. The material can also be HIPed, sintered HIPed or hot pressed to increase density.

Composites made in accordance with the present invention will preferably have an absolute value of the temperature coefficient of volume resistivity of not larger than 1.8% per ° C. in the temperature range of from 25 to 75° C. They will also preferably have a change in the absolute value of volume resistivity of not larger than 200%, more preferably not larger than 70% in the voltage range of from 1 volt to 100 volts.

EXAMPLE 1

Powders containing $ZrO_2$ with 3 mole percent $Y_2O_3$ and $La_{0.9}Sr_{0.1}CrO_3$ were prepared by mixing in the proportions required to yield the compositions listed in table 1:

TABLE 1

| Sample # | Stabilized $ZrO_2$ (weight %) | La-Chromate (weight %) |
|---|---|---|
| 1 | 80.0 | 20.0 |
| 2 | 77.5 | 22.5 |
| 3 | 75.0 | 25.0 |

ZrO2 with 3 mole % $Y_2O_3$ (HSY-3.0 from Daiichi Kigenso Corp.) was mixed in an aqueous solution of Cr-Nitrate, La-Nitrate, and Sr-Nitrate. The slurries were poured while stirring into an aqueous solution of $NH_4OH$ and $(NH_4)(HCO_3)$. The mix was then dried and then calcined at 850° C. for 2 hours.

The calcined powders were ball milled in ethanol with Y-TZP media and dried. Samples were prepared by isostatic pressing of the powders at 20,000 psi, followed by air firing at 1500° C. for 1 hour in a covered crucible with a slight flow of nitrogen into the crucible. The density was measured by buoyancy method. The resistivity was measured on ~1 mm thick plates at 100 volts DC at 25° C. A DC power source and an ammeter were connected to the electrodes on both surfaces of the samples. The resistance was found from the leakage current and the applied voltage in accordance with Ohm's law, and the volume resistivity was calculated from the resistance.

TABLE 2

| Sample | Resistivity (ohm-cm) | Fire Density (g/cc) |
|---|---|---|
| 1 | $3.1 \times 10^8$ | 5.99 |
| 2 | $1.0 \times 10^6$ | 5.93 |
| 3 | $6.3 \times 10^4$ | 6.03 |

Further measurements were made on samples 1 and 2 as a function of voltage. The percent change in resistivity from 1v to 100v is calculated according to an equation Percent Change=(R1−R100)/R1×100, wherein R1 is a volume resistivity at 1v and R100 is a volume resistivity at 100v.

TABLE 3

| Voltage (volts) | Sample 1 Resistivity (ohm-cm) | Sample 2 Resistivity (ohm-cm) |
|---|---|---|
| 1 | $6.0 \times 10^8$ | $2.5 \times 10^6$ |
| 10 | $5.2 \times 10^8$ | $1.7 \times 10^6$ |
| 100 | $3.1 \times 10^8$ | $1.0 \times 10^6$ |
| Percent change 1 v–100 v | 48% | 60% |

Further measurements were made on samples 1 and 2 as a function of temperature with an applied voltage of 0.5 volts. Here, the temperature coefficient TCR of volume resistivity (%/° C.) is calculated according to an equation TCR (%/° C.)=$(R_{25}-R_{75})/(R_{25}\times 50)\times 100$, wherein $R_{25}$ is a volume resistivity at 25° C. and $R_{75}$ is a volume resistivity at 75° C.

TABLE 4

| Temp. (° C.) | Sample 1 Resistivity (ohm-cm) | Sample 2 Resistivity (ohm-cm) |
|---|---|---|
| 25 | $8.8 \times 10^8$ | $5.8 \times 10^6$ |
| 50 | $3.9 \times 10^8$ | $2.9 \times 10^6$ |
| 75 | $1.8 \times 10^8$ | $1.5 \times 10^6$ |
| TCR (%/° C.) | 1.59 | 1.48 |

These measurements show a wide range of resistivities are possible with this system. Additionally, the resistivity is not highly sensitive to temperature and voltage changes.

EXAMPLE 2

An aqueous solution of Cr-Nitrate, La-Nitrate, and Sr-Nitrate was prepared to yield the composition $La_{0.9}Sr_{0.1}CrO_3$. The solution was poured while stirring into a Aqueous solution of $NH_4OH$ and $(NH_4)(HCO_3)$. The mix was then dried and then calcined at 800° C. for 2 hours. The calcined powder was mixed with $ZrO_2$ with 3 mole percent $Y_2O_3$ (HSY-3.0 from Daiichi Corp.) and CuO (Johnson Matthey Inc.) in the proportions required to yield 22 wt. % $La_{0.9}Sr_{0.1}CrO_3$, 2 wt. % CuO, and 76 wt. % HSY-3.0.

The mix was ball milled in ethanol with Y-TZP media and dried. Samples were prepared by isostatic pressing of the powders at 20,000 psi, followed by air firing at 1450° C. for 2 hours in a covered crucible with a slight flow of nitrogen into the crucible. The resistivity was measured on ~1 mm thick plates at 100 volts DC and density was measured by buoyancy method. The sample so made had a resistivity of $8.8\times10^4$ ohm-cm and a fired density of 5.97 g/cc.

What is claimed is:

1. A composite material comprising:

a) about 65–95 volume percent zirconia; and b) about 5–35 volume percent conductive metal oxide wherein in the temperature range of from 25 to 75° C., said composite material having an absolute value of the temperature coefficient of volume resistivity of not larger than 1.8% per ° C.

2. A composite material comprising:

a) about 65–95 volume percent zirconia; and b) about 5–35 volume percent conductive metal oxide wherein in the voltage range of from 1 volt to 100 volts said composite material having a change in the absolute value of volume resistivity of not larger than 70%.

3. A composite material comprising:

a) about 65–95 volume percent zirconia b) about 5–35 volume percent conductive metal oxide wherein in the voltage range of from 1 volt to 100 volts said composite material having a change in the absolute value of volume resistivity of not larger than 200%.

4. A composite material comprising:

a) about 65–95 volume percent zirconia; and b) about 5–35 volume percent conductive metal oxide comprising a perovskite-type oxide of the formula $A_XB_YCrO_3$, where A is a metal selected from the group consisting of La, Y, Ln, Sc, Nd, Yb, Er, Gd, Sm and Dy, and mixtures thereof; B is a metal selected from the group consisting of Ba, Sr and Ca, and Mg, and mixtures thereof; X is 0.5 to 1; Y is 0 to 0.5 and X+Y is about 1.

5. The composite material of claim 4 wherein said zirconia is partially stabilized zirconia.

6. The composite material of claim 5 wherein said zirconia is stabilized with 2.6% to 10% of a metal oxide selected from the group comprising $Y_2O_3$, stabilizing rare earth oxides, MgO, CaO and mixtures thereof.

7. The composite material of claim 4 wherein sufficient conductive phase is present to achieve volume resistivities of from about $1\times10^4$ ohm-cm to about $1\times10^{11}$ ohm-cm.

8. A composite material comprising:

a) from about 65 to 95 volume percent of a toughened zirconia consisting of zirconia and from 2.6% to 10% of a stabilizing metal oxide in which the stabilizing agent is selected from the group consisting of yttria, and stabilizing rare earth oxides (La, Y, Ce, Sc, Nd, Yb, Er, Gd, Sm and Dy) and magnesia, calcia, and mixtures thereof; and b) from about 5 to about 95 volume percent electro-conductive metal oxide of the perovskite-type having the formula $A_XB_YCrO_3$ where: A is a metal selected from the group consisting of La, Y, Sc, Nd, Yb, Er, Gd, Sm and Dy, and mixtures thereof; B is a metal selected from the group consisting of Ba, Sr and Ca, and Mg, and mixtures thereof; X is about 0.5 to 1 Y is about 0 to 0.5 and X+Y is about 1.

9. The composite material of claim 8 wherein said electro-conductive metal oxide is $La_xSr_yCrO_3$.

10. The composite material of claim 8 where up to 15 atomic percent of the Cr in said electro-conductive ceramic is replaced with Cu or Zn and mixtures thereof.

11. The composite material of claim 8 wherein up to 2 weight percent of CuO, or $Cu_2O$ can be added in excess to the overall mix.

12. The composite material of claim 8 wherein up to 5 atomic percent of the Cr in said electro-conductive ceramic is replaced with Nb.

13. The composite material of claim 8 wherein up to 15 percent of the Cr in said electro-conductive ceramic is replaced with Al, Fe, or Mn and mixtures thereof.

14. The composite material of claim 8 wherein said zirconia is substantially tetragonal structure.

15. The composite material of claim 8 wherein said zirconia grain size is substantially 1 micron or less.

16. The composite material of claim 8 wherein said zirconia is substantially tetragonal structure and contains a rare earth oxide selected from the group consisting of Y2O3, CeO2, Er2O3, and La2O3, there being at least enough of said rare earth oxide to increase the amount of ZrO2 having a tetragonal crystal structure, but not enough of said rare earth oxide to form substantial amounts of said ZrO2 having a cubic crystal structure.

17. The composite material of claim 8 having a volume resistivity of from about $1\times10^4$ ohm-cm to about $1\times10^{11}$ ohm-cm.

18. The composite material of claim 8 having a volume resistivity of from about $1\times10^6$ ohm-cm to about $1\times10^9$ ohm-cm.

19. The composite material of claim 8 wherein up to 50 volume percent of the zirconia is replaced with alumina.

* * * * *